United States Patent [19]

Sayles

[11] Patent Number: 4,881,464

[45] Date of Patent: Nov. 21, 1989

[54] SIGNAL OR RESCUE FLARE OF VARIABLE LUMINOSITY

[75] Inventor: David C. Sayles, Huntsville, Ala.

[73] Assignee: The United States of America as represented by the Secretary of the Army, Washington, D.C.

[21] Appl. No.: 319,581

[22] Filed: Mar. 6, 1989

[51] Int. Cl.[4] ..... B41K 1/48; C06B 45/10

[52] U.S. Cl. ..... 102/336; 102/290; 149/116; 149/19.3

[58] Field of Search ..... 149/19.3, 116; 102/336, 102/290

[56] References Cited

U.S. PATENT DOCUMENTS

| | | | |
|---|---|---|---|
| 3,888,177 | 6/1975 | Tyroler | 102/336 |
| 3,895,578 | 7/1975 | Shaw et al. | 102/290 |
| 3,972,856 | 8/1976 | Mitsch et al. | 149/19.3 |
| 3,983,816 | 10/1976 | Cornia | 149/116 |
| 4,062,709 | 12/1977 | Castaneda et al. | 149/19.3 |
| 4,768,439 | 9/1988 | Singer et al. | 102/336 |

*Primary Examiner*—Edward A. Miller

*Attorney, Agent, or Firm*—Freddie M. Bush; James T. Deaton

[57] ABSTRACT

A signal flare with luminous oscillations resulting from a combustible composition of octafluorohexanediol, magnesium or aluminum, chlorinated benzene, an inorganic oxidizer, and polyisocyanate.

9 Claims, 1 Drawing Sheet

SIGNAL OR RESCUE FLARE OF VARIABLE LUMINOSITY

DEDICATORY CLAUSE

The invention described herein may be manufactured, used, and licensed by or for the Government for governmental purposes without the payment to me of any royalties thereon.

BACKGROUND OF THE INVENTION

1. Field of the Invention

This invention relates to a signal flare which can be used for a variety of purposes. For example, this invention can be used to communicate a state of emergency, a warning of a potential danger, or that help is needed.

2. Description of Related Art

A variety of signal flares have been on the commercial market for a long time. However, these flares only have the capacity to illuminate at a constant rate. In particular, specific reference is made to flare compositions which contain a combination of the following ingredients: aluminum or magnesium powder, ammonium perchlorate, an aromatic halocarbon, and a fluorocarbon binder. This invention is unique because it has the capacity to provide variable luminosity.

SUMMARY OF THE INVENTION

The object of the invention is to provide a signal flare with improved characteristics. Because this invention has a flame which oscillates as it burns, the flame is more easily seen and recognized at much greater distances than conventional steady burning flares. In addition, the oscillations can be used to identify a particular source or to communicate a specific message. These oscillations also enable the flare to burn for a longer period of time for a given amount of combustible composition than a flare burning at a steady rate.

DESCRIPTION OF THE PREFERRED EMBODIMENTS

Figure 1:
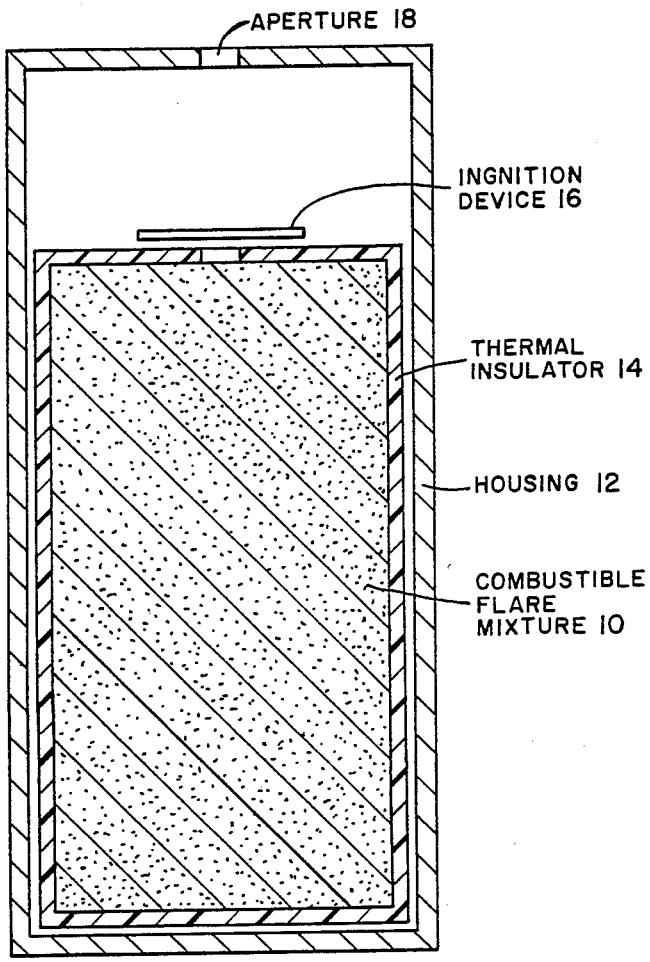
FIG. 1 represents the basic configuration of the variable luminosity signal flare with its basic components.

The variable luminosity signal flare is made up essentially of a combustible composition encased within a housing. The housing contains an aperture through which the combustible mixture burns in an oscillatory fashion once the mixture has been ignited. Ignition is initiated by means of an igniter which may also be positioned within the housing.

The novelty of this invention lies within the combustible composition. It is this mixture which gives this signal flare its unique oscillatory flame. The combustible composition consists of octafluorohexanediol, magnesium or aluminum, chlorinated benzene, an inorganic oxidizer, and polyisocyanate. The inorganic oxidizer can be obtained from several sources; the most practical ones would be either ammonium perchlorate or ammonium nitrate. The polyisocyanate can also be obtained from various sources, but the most workable ones would be 1,6-hexane diisocyanate, toluene diisocyanate, 1,4-butane diisocyanate, and isophorone diisocyanate.

The best results were obtained with forty (40) percent by weight of 2,2,3,3,4,4,5,5-octafluoro-1,6-hexanediol, twenty-four (24) percent by weight of magnesium, eighteen-and-one-half (18.5) percent by weight of 1,2,3,4,5,6-hexachlorobenzene, sixteen (16) percent by weight of ammonium perchlorate, and one-and-one-half (1.5) percent of 1,6-hexane diisocyanate. The above composition has the following mechanical and ballistic properties:

| MECHANICAL PROPERTIES | +75° F. | +150° F. |
|---|---|---|
| Strain @ Maximum Stress | 38% | 20% |
| Strain @ Rupture | 78% | 30% |
| Maximum Stress @ 70° F. | 78 psi | 46 psi |
| Modulus of Elasticity | 332 psi | 235 psi |
| BALLISTIC PROPERTIES | | |
| Cured Density | 0.066 lb/in$^3$ | |
| Burning Rate | 0.02 $(P_c/12.7)^{0.60}$ | |
| End of Mix Viscosity | 2 Kp @ 110° F. | |

Acceptable results can still be obtained if the proportion of each component is allowed to change by approximately ten (10) percent of its own weight.

The combustible composition is prepared by first mixing the octafluorohexanediol compound with the chlorinated benzene. Next, the aluminum or magnesium is added followed by an inorganic oxidizer. Finally, the polyisocyanate is added for structural integrity.

Figure 2:
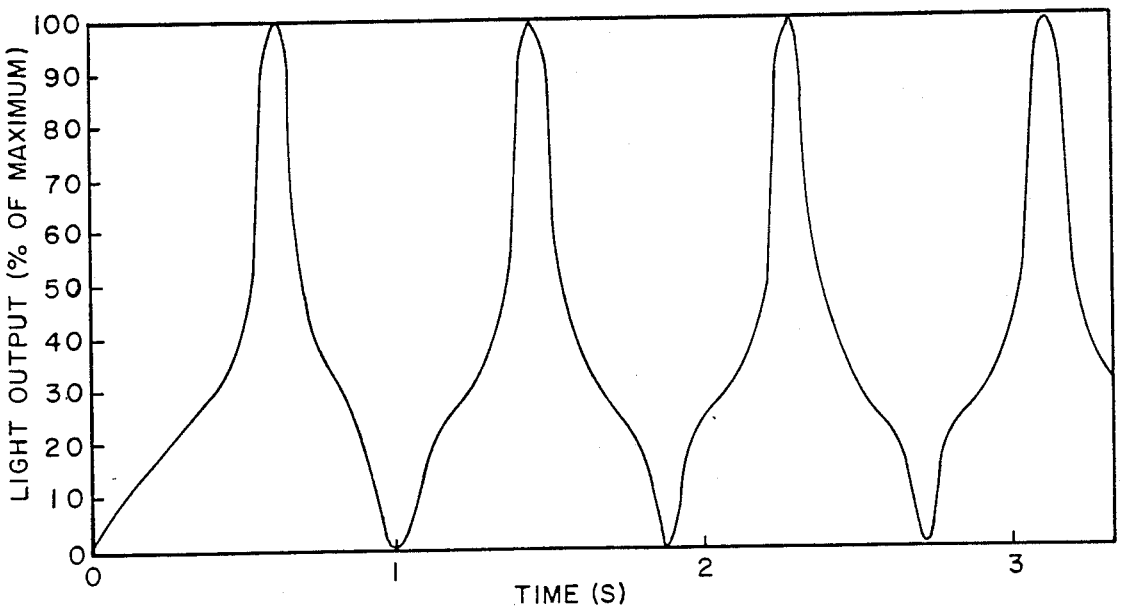
FIG. 2 is a plot of light output versus time for the variable luminosity signal flare.

FIG. 2 is a graph of light output versus time for a typical mixture. The fluctuation range of the oscillatory flame was observed to vary with the magnesium particle size. The smaller the particle size, the greater the fluctuation range of the oscillatory flame.

The variable luminosity signal flare is constructed by placing the combustible flare mixture (10) inside a housing (12), preferably a metal tube, which is lined with a thermal insulator (14). Various phenolic materials can serve as this thermal insulator. The thermal insulator performs the dual function of retaining heat for the combustion process and keeping the housing cool enough so it can be hand-held. An ignition device (16) can also be enclosed within the container to start the combustion process. An aperture (18) is provided in the housing through which the mixture burns. The larger the hole, the faster the burn, and the smaller the hole, the slower the burn.

The intense flame produced by this flare is attributed to the presence of magnesium. The magnesium reacts with the halocarbons producing carbon, and magnesium halides. When aluminum is substituted for magnesium, the reaction is similar but the flame is much less intense.

The luminous oscillations result from the out-of-phase coupling of the condensed, chemical reaction phase with the thermal phase. Upon ignition, the magnesium reacts with the halocarbons to produce an intense flame. As the rate of burning decreases, the heat of reaction is stored in the flare mixture causing the temperature of the condensed phase to increase. Upon reaching a given temperature, the magnesium again reacts with halocarbons producing a brilliant light and starting the cycle over again.

I claim:

1. A composition of matter, consisting essentially of:

a. about 36 to 44 percent by weight of an octafluorohexanediol compound;

b. about 21 to 27 percent by weight of a metal selected from the group consisting of magnesium and aluminum;

c. about 16 to 21 percent by weight of a chlorinated benzene compound;

d. about 14 to 18 percent by weight of an inorganic oxidizer; and e. about 1 to 3 percent by weight of an polyisocyanate compound.

2. A composition of matter as recited in claim 1, wherein a. said inorganic oxidizer is selected from the group consisting of ammonium perchlorate and ammonium nitrate; and b. said polyisocyanate compound is selected from the group consisting of 1,6-hexane diisocyanate, toluene diisocyanate, 1,4-butane diisocyanate, and isophorone diisocyanate.

3. A composition of matter as recited in claim 1, wherein said octafluorohexanediol compound is 2,2,3,3,4,4,5,5-octafluoro-1,6-hexanediol.

4. A composition of matter as recited in claim 1, wherein said chlorinated benzene compound is 1,2,3,4,5,6-hexachlorobenzene.

5. A composition of matter, consisting essentially of:

a. about 40 percent by weight of 2,2,3,3,4,4,5,5-octafluoro-1,6-hexanediol;

b. about 24 percent by weight of magnesium;

c. about 18.5 percent by weight of 1,2,3,4,5,6-hexachlorobenzene;

d. about 16 percent by weight of ammonium perchlorate; and e. about 1.5 percent by weight of 1,6-hexane diisocyanate.

6. A composition of matter as recited in claim 1, wherein said composition is enclosed in a housing having therein an aperture for the passage of products of combustion of said composition to the exterior of said housing.

7. A composition of matter as recited in claim 6, wherein said housing is insulated.

8. A composition of matter as recited in claim 7, wherein said insulation is in the form of a phenolic sleeve surrounding said composition.

9. A composition of matter as recited in claim 6, wherein an ignition means is also attached to said housing for initiating combustion of said composition.

* * * * *